US010258864B2

(12) United States Patent
Rasinger

(10) Patent No.: US 10,258,864 B2
(45) Date of Patent: Apr. 16, 2019

(54) AIR CUSHION

(71) Applicant: BAGJUMP ACTION SPORTS GMBH, Innsbruck (AT)

(72) Inventor: Martin Rasinger, Innsbruck (AT)

(73) Assignee: BAGJUMP ACTION SPORTS GMBH, Innsbruck (AT)

( * ) Notice: Subject to any disclaimer, the term of this patent is extended or adjusted under 35 U.S.C. 154(b) by 0 days.

(21) Appl. No.: 14/915,865

(22) PCT Filed: Sep. 5, 2014

(86) PCT No.: PCT/EP2014/068917

§ 371 (c)(1),
(2) Date: Mar. 1, 2016

(87) PCT Pub. No.: WO2015/032887

PCT Pub. Date: Mar. 12, 2015

(65) Prior Publication Data

US 2016/0199723 A1 Jul. 14, 2016

(30) Foreign Application Priority Data

Sep. 5, 2013 (EP) ..... 13183178

(51) Int. Cl.

| | |
|---|---|
| ***A63C 19/04*** | (2006.01) |
| ***A63B 6/00*** | (2006.01) |
| ***A63B 6/02*** | (2006.01) |
| ***A63B 71/00*** | (2006.01) |

(52) U.S. Cl.

CPC ..... *A63C 19/04* (2013.01); *A63B 6/00* (2013.01); *A63B 6/02* (2013.01); *A63B 71/0054* (2013.01); *A63B 2071/0063* (2013.01); *A63B 2209/10* (2013.01); *A63B 2210/50* (2013.01); *A63B 2225/62* (2013.01)

(58) Field of Classification Search

CPC ..... A63B 31/00; A63B 31/12; A63B 5/00; A63B 5/11; A63B 71/00; A63B 71/02

USPC ..... 472/134; 473/415, 466; 446/220–224

See application file for complete search history.

(56) References Cited

U.S. PATENT DOCUMENTS

| | | | | |
|---|---|---|---|---|
| 5,462,505 A * | 10/1995 | Blair | A63B 5/11 472/134 |
| 7,108,608 B2 * | 9/2006 | Field | A63G 31/12 472/134 |
| 7,335,109 B2 * | 2/2008 | Chen | A63G 31/12 446/220 |

(Continued)

FOREIGN PATENT DOCUMENTS

| | | |
|---|---|---|
| DE | 202008014715 DE | 8/2013 |
| WO | WO2010112953 | 7/2010 |
| WO | WO2013120039 | 8/2013 |

OTHER PUBLICATIONS

Notification of the Transmittal of Translation of the International Preliminary Report on Patentability for PCT Application No. PCT/EP2014/068917 dated Mar. 17, 2016.

(Continued)

*Primary Examiner* — Kien T Nguyen
(74) *Attorney, Agent, or Firm* — Workman Nydegger

(57) ABSTRACT

An air cushion for absorbing bounces, including at least one air chamber and one air inlet valve, characterized in that the air chamber has a multiplicity of protrusions in the direction of impact.

15 Claims, 2 Drawing Sheets

(56) References Cited

U.S. PATENT DOCUMENTS

| | | | | |
|---|---|---|---|---|
| 7,357,728 | B2 * | 4/2008 | Osler-Weppenaar | A63B 6/02 182/137 |
| 2004/0204255 | A1 * | 10/2004 | Murphy | E04H 15/22 472/134 |
| 2015/0051007 | A1 * | 2/2015 | Weekes | A63G 31/12 472/134 |

OTHER PUBLICATIONS

International Preliminary Report on Patentability for PCT Application No. PCT/EP2014/068917 dated Mar. 17, 2016.
Notification concerning Transmittal of International Preliminary Report on Patentability for PCT Application No. PCT/EP2014/068917 dated Mar. 17, 2016.
International Preliminary Report on Patentability for PCT Application No. PCT/EP2014/068917 dated Mar. 17, 2016 (German).
ISR and WO cited in PCT Application Serial No. PCT/EP2014/068917 dated Jan. 20, 2015.

* cited by examiner

AIR CUSHION

The invention relates to an air cushion for absorbing bounces, including at least one air chamber and one air inlet valve. The invention further relates to an air cushion having a pump or a blower.

Air cushions of this type are used in various kinds of sports for absorbing bounces and jumps as well as a protection against impacts. For example, such air cushions are used in snowboarding, skiing, Freestyle skiing, BMX riding, mountain biking, climbing, moto crossing or jumping from towers and the like.

It is the task of the air cushion to absorb the kinetic energy of a person, who bounces onto the air cushion at a high speed, in a way so that injuries are prevented. The air cushion, however, has to be manufactured from materials that may endure high energy input without damage. In the case of very high impact energies, as consequence of the build-up of pressure this may lead to rupture or cracks in the air cushion. Accordingly, there has to be found a suitable compromise between material strength, on the one side, and convenient dampening for the person, on the other side.

In prior art, hence, there is chosen a rigid material for the air chamber, and the pressure in the air cushion is selected to be low. This will lead to the person diving deep into the air cushion and, as a consequence, needing a long time to exit the air cushion again.

For use in competitions or for intensive trainings, this state will prove disappointing as the long breaks between two jumps are too long for the audience as well as for the athletes practising.

It is, hence, the task of the present invention to provide an air cushion of the type initially mentioned, which—at continuous good rigidity—may be operated at higher pressures, so that the person bouncing onto will dive less deep into the air cushion and may thus exit the air cushion more rapidly.

This task is solved by an air cushion for absorbing bounces, including at least one air chamber and one air inlet valve, characterized in that the air chamber has a multiplicity of protrusions in the direction of impact.

The protrusions may be formed column-like or tube-like, respectively. The protrusions are further connected with the air chamber and are themselves filled with air.

In one embodiment variant, the protrusions are formed essentially cylinder-shaped. The protrusions may be formed, e.g., in the shape of circular cylinders. The cylinder-like protrusions may protrude essentially vertically from the surface of the air cushion.

The air chambers have openings, to which the respective protrusion is adjacent.

The protrusion may be formed in one embodiment variant such that at least a part of the extension thereof will project beyond the opening. To this end, the protrusion, for example, may have a bend.

In one embodiment variant, the protrusion has a first cross-sectional area in the area immediately adjacent to the air cushion and a second cross-sectional area spaced therefrom, wherein the first cross-sectional area and the second cross-sectional area are formed differently. In one embodiment variant the second cross-sectional area is larger than the first cross-sectional area. For example, the first cross-sectional area may be a circular area, and the second cross-sectional area may be a rectangle. The surface area of the rectangle is preferably larger than the surface area of the circle. This may be achieved, e.g., by way of a protrusion in the form of a circular cylinder, which has a bend at about 90°. This means that there is formed a first circular cylinder and a second circular cylinder, which are arranged approximately in the shape of an L.

In a preferred embodiment variant there is provided that the protrusion will project beyond the opening at least in a part of the extension thereof, by the protrusion—preferably in the area of the end of the protrusion—being connected with the surface of the air chamber. The protrusion may, for example, be attached at the external end thereof with a connecting means using a band, a rope or the like at the air chamber and thus being bent downwards.

In one embodiment variant there is provided that the protrusions are formed permeable to air at least in some areas. This measure will locally reduce air pressure, as a small amount of air may rapidly exit on impact, which will entail smoother landing or a softer impact, respectively.

Especially preferably there is provided that the protrusions in the area of the base of the respective protrusions are formed permeable to air. The remaining areas of the protrusion are essentially not permeable to air.

Permeable to air in the sense of the invention means that on designated use this area will not be air-tight but rather permeable to air within the air cushion. Permeability to air in this area is preferably such that in the case of pressure conditions, wherein the pressure within the air cushion is higher than outside of the air cushion, air will flow through this area. Permeability to air in the area of the base also means that at this point there is given a higher a level of permeability to air than in the air chamber and the remaining parts of the protrusion.

Base designates in the sense of the invention that area, which is preferably intermediately adjacent to the opening, in contrast to the end of the protrusion, which designates the area of the protrusion that is situated farthest from the opening.

The area permeable to air may be formed in various ways.

In one embodiment variant there is provided that the area permeable to air is formed by a net or a grid.

In one embodiment variant there is provided that the area permeable to air is formed by openings, preferably drill holes.

In one embodiment variant there is provided that the area permeable to air is formed by a detachable closing means. As a detachable closing means there is conceivable a zipper. Another detachable closing means would be, for example, a Velcro® fastener.

Such detachable closing means have the advantage that in this way the protrusion may be detached from the air chamber. At the same time, it has shown that such detachable closing means are permeable to air to a sufficient extent.

There may also be envisaged combinations of areas permeable to air of the type mentioned above, e.g., combinations of zipper and/or net and/or Velcro® fastener and/or grid and/or openings.

In one embodiment variant there may be provided that there is arranged a top sheet on the protrusions. The top sheet may be connected at the base edge of the air cushion with each side using ropes by means of side parts. Such a top sheet on the protrusions will result in a dampening chamber filled with air between the air chamber and the top sheet, which will deflate at the corners of the air cushion upon impact, e.g., through ventilation openings. The impact experienced will thus be even softer. Accordingly, there may be provided that the top sheet will also extend across the side areas of the air cushion, wherein there are provided ventilation openings in the side parts. The ventilation openings are preferably disposed at the fringe area or at the edges, respectively.

There may further be provided that there is provided a multiplicity of air chambers. There may be provided, e.g., one air chamber per 1 $m^2$ surface. A multiplicity of individual air chambers will advantageously dampen the impact, maintaining stability of the air cushion.

In operation, the air cushion is usually continuously supplied with air. To this end, there is provided a blower or a pump, which are connected with the air inlet valve.

The protrusions may, e.g., have a length of up to 150 cm, a diameter of up to 50 cm. The entire air cushion preferably has at least 4 $m^2$ base area. The air cushion may be formed in a round, square, rectangular, triangular etc. shape. The impact surface need not be arranged only horizontally, but may also deviate from the horizontal, i.e. being inclined.

Materials, which have proven to be useful for air cushions and protrusions, are, e.g., plastic polymers, possibly reinforced by fibres or fabrics. A polyester (e.g., PET) or PVC as a basic material having a PET coating with fabrics having 1100 dtex, mass per unit area of 450 g/$m^2$m would constitute suitable examples.

In one embodiment variant of the invention there is provided that the air cushion has a pressure valve.

The invention further relates in one aspect to an arrangement of air cushion and pump or blower.

Further details and advantages of the invention are now illustrated by way of the following figures.

Figure 1:
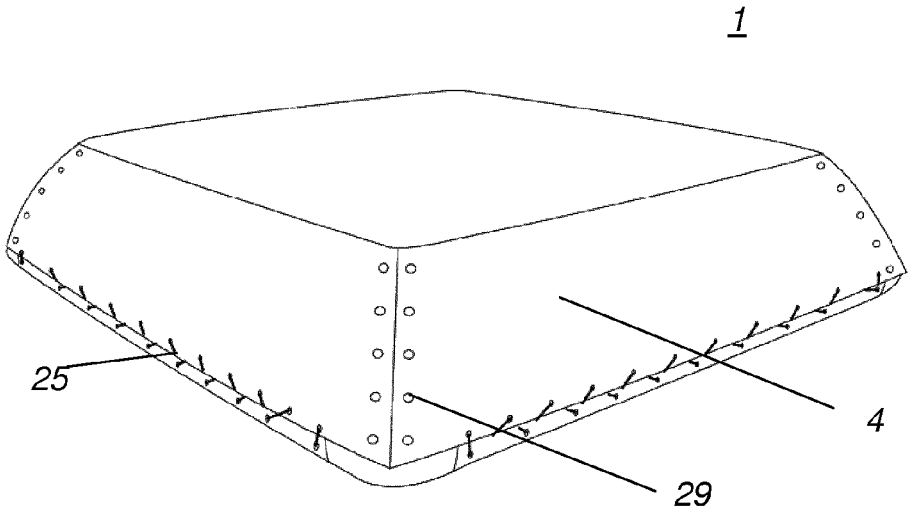
FIG. 1 shows an air cushion having a top sheet in an oblique view.

In FIG. 1 there is shown in an oblique view an air cushion 1 for absorbing bounces. There is made reference to the FIGS. 2 and 3 for illustration of the configuration. The air cushion 1 has a multiplicity of air chambers 2, which are, however, only shown in an external view. An air inlet valve as well as an optional pressure valve for the exit of air are not visible in the embodiment example shown. As illustrated in the FIGS. 2 and 3, the air chambers 2 have a multiplicity of protrusions 3 in the direction of impact. The protrusions 3 are formed column-like or tube-like, respectively, and have at least the form of circular cylinders in some portions. The protrusions are further connected with the air chamber 2 and are themselves filled with air. In the FIGS. 4 and 5 there can be seen that the cylinder-like protrusions 3 protrude essentially vertically from the surface 20 of the air cushion 1. The exact type of connection will be more thoroughly detailed in the FIGS. 4 and 5.

Figure 2:
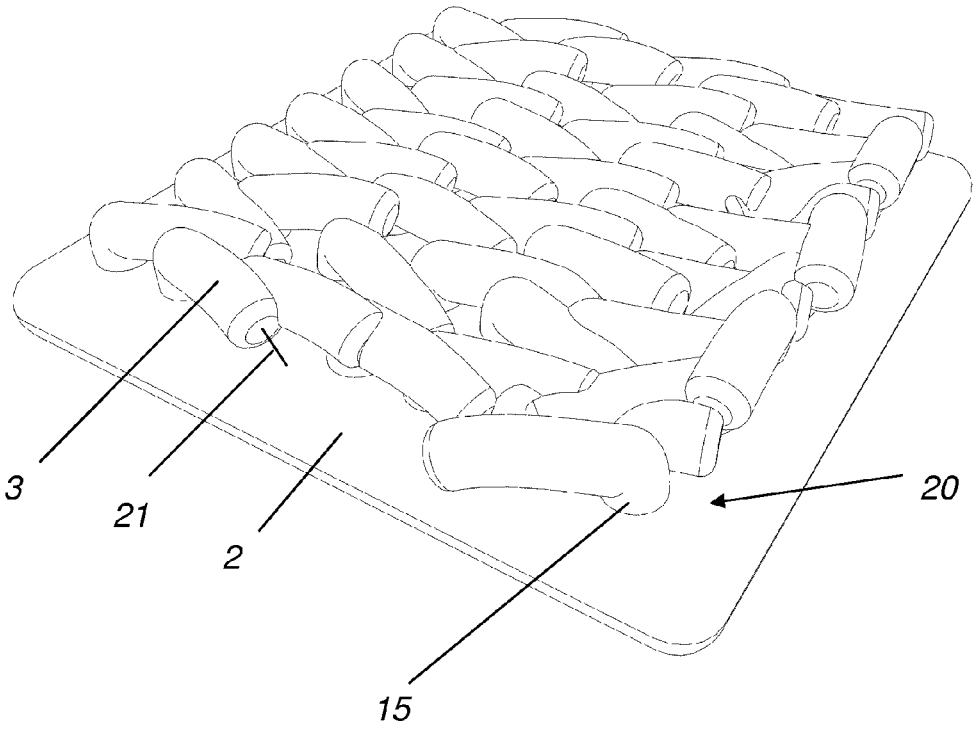
FIG. 2 shows an air cushion having protrusions without a top sheet.
Figure 3:
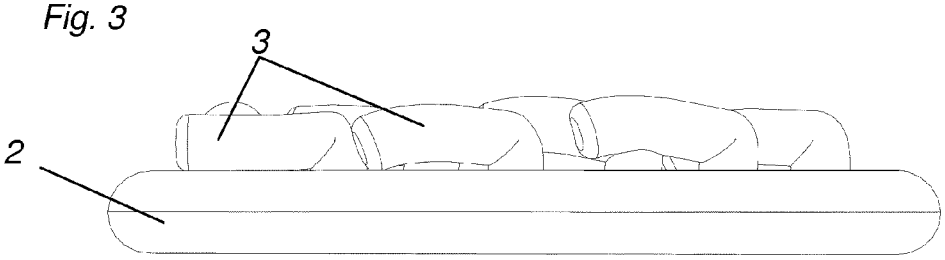
FIG. 3 shows a side view of FIG. 2.

In the FIGS. 2 and 3 there is illustrated that the cylinder-like protrusions 3 do not protrude essentially vertically from the surface 20 of the air cushion 1. The protrusions 3 may be made innately having a bend, or they may be attached to the surface 20 of the air chambers 2—e.g., using a band, a rope 21 or the like. In this way, the protrusions 3 are curved downwards or bent. In this way there is realized that a majority of the extension of the protrusion 3 will project beyond the opening 7. Thereby, the protrusion 3 in the area of the end of the protrusion 3 is connected with the surface 20 of the air chamber 2. To this end, the protrusion 3 has a suitable connecting means 22.

Figure 4:
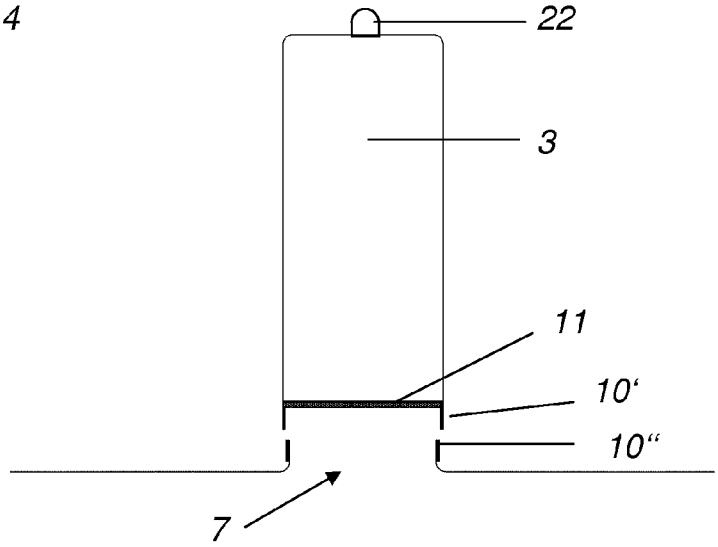
FIG. 4 shows an embodiment example of a protrusion.
Figure 5:
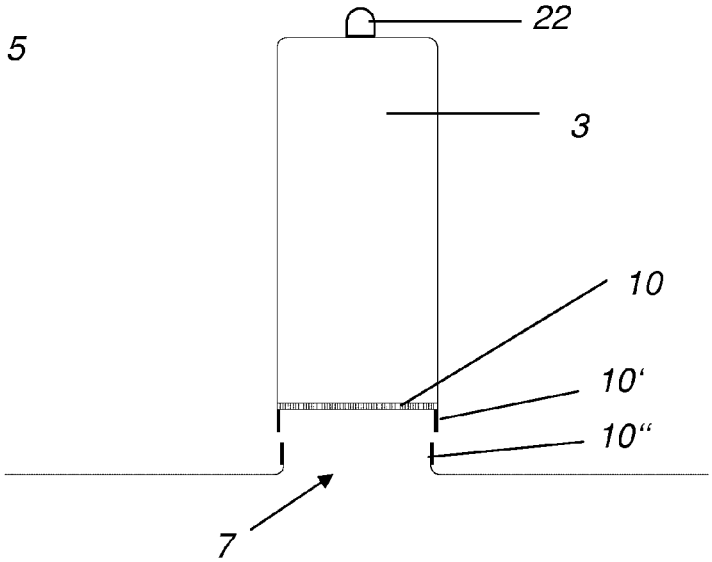
FIG. 5 shows an embodiment example of a protrusion.

In the FIGS. 4 and 5 there are illustrated possible embodiment variants of the protrusions 3. At first, there may be seen that the protrusions 3 are rested on the air chamber 2. To this end, the air chamber 2 has an opening 7, to which the respective protrusion 3 is adjacent. Protrusion 3 and air chamber 2 are essentially composed of the same materials. The protrusions 3 have portions 10, 11 permeable to air in the area of the base 15. This measure will locally reduce air pressure, as a small amount of air may rapidly exit on impact, which will entail smoother landing or a softer impact, respectively. In FIG. 4 there is, for this reason, provided a net 11, which is embodied air-tight. Further, there is provided in FIG. 4 a detachable closing means 10 in the form of a Velcro® fastener. In the area of the opening 7 of the air cushion 2, there is provided, for this reason, a frieze band 10'. The protrusion 3 has a hook band 10", by means of which the protrusion 3 may be detachably attached at the air cushion 1.

Contrary to the embodiment example of FIG. 4, the example of FIG. 3 does not have a net but rather a zipper. Also herein, there may be additionally provided a net 11.

The examples of the FIGS. 4 and 5 were examined with and without net 11, with and without zipper and with and without net in all variants. There has been shown that the zipper 10 alone as well as the Velcro® fastener 10', 10" alone as well as the net 11 alone do have sufficient permeability to air for dampening impact. The combination of detachable closing means 10 plus grid/net/recesses 11 or two detachable closing means 10, respectively, does, however, have the advantage that wear in the protrusions 3 due to cracks is not only less but there is also given the fact that the protrusions 3 may be replaced. This will also lead to advantages in transport.

The embodiment example of FIG. 1 may be produced, e.g., using the example of FIG. 2, by arranging a top sheet 4 on top of the protrusions 3. The top sheet 4 is connected, e.g., using ropes from rubber-elastic material at the base edge of the air cushion 1 of each side with ropes 25. The top sheet 4 furthermore has ventilation openings 28 at the side, through which air may exit. There may also be used, however, the example of FIG. 2 without top sheet 4 as in FIG. 1.

The air chambers 2, the top sheet 4 or also the protrusions 3 may have a plastic film having a fabric manufactured there into. In this way, the walls of the air chamber 2, the top sheet 4 and the protrusions 3 will be essentially air-tight. The surface 20 of the air cushion 1 is preferably between 4 $m^2$ and 720 $m^2$, in particular between 8 $m^2$ and 720 $m^2$.

The invention claimed is:

1. An air cushion for absorbing bounces from a direction of impact, the air cushion comprising:

at least one air chamber that includes an impact-directed surface that is arranged transverse to the direction of impact, the air chamber being formed of material that endures repeated high-energy impact and that is essentially impermeable to air; and a plurality of protrusions arranged in an array, each of the plurality of protrusions protruding from the impact-directed surface of the air chamber toward the direction of impact, wherein there is disposed a top sheet that overlays the protrusions;

wherein each of the protrusions is permeable to air at least in a first area of the protrusion and essentially impermeable to air in at least a second area of the protrusion, and wherein each the of the protrusions are detachably coupled to the at least one air chamber by a detachable closing device, and each of the detachable closing devices is permeable to air such that air is permitted to flow from within the air cushion to outside the air cushion at the detachable closing device.

2. An air cushion according to claim 1, wherein each of the protrusions are formed as a column.

3. An air cushion according to claim 1, wherein each of the protrusions are formed as a tube.

4. An air cushion according to claim 1, wherein the protrusions are connected with the air chamber.

5. An air cushion according to claim 4, wherein the protrusions are filled with air.

6. An air cushion according to claim 1, wherein the protrusions are formed essentially cylinder-shaped.

7. An air cushion according to claim 6, wherein the protrusions are formed essentially circular cylinder-shaped.

8. An air cushion according to claim 1, wherein each of the protrusions projects in at least a part of an extension in a direction transverse to the direction of impact and thereof beyond the opening in the air cushion, to which the protrusion is adjacent to.

9. An air cushion according to claim 8, wherein the protrusion is connected with the surface of the air chamber.

10. An air cushion according to claim 9, wherein the protrusion is connected with the surface of the air chamber in the area of the end of the protrusion.

11. An air cushion according to claim 1, wherein the at least first area that is permeable to air is formed by a net, a grid, openings, or drill holes.

12. An air cushion according to claim 1, wherein the detachable closing device comprises a velcro fastener, a zipper or a combination thereof.

13. An air cushion for absorbing bounces from a direction of impact, the air cushion comprising:

at least one air chamber that includes an impact-directed surface that is arranged transverse to the direction of impact, the air chamber being formed of material that endures repeated high-energy impact and that is essentially impermeable to air; and at least one air inlet valve, wherein the air chamber has a multiplicity of protrusions, each of the multiplicity of protrusions protruding from the impact-directed surface of the air chamber toward the direction of impact, wherein there is disposed a top sheet that overlays the protrusions, and wherein each of the protrusions is detachably attached at the air cushion by a detachable closing device such that air is permitted to flow from within the air cushion to outside the air cushion at the detachable closing device.

14. An air cushion according to claim 13, wherein the detachable closing device comprises a velcro fastener, a zipper or a combination thereof.

15. An air cushion for absorbing bounces from a direction of impact, the air cushion comprising:

at least one air chamber having an upper surface, the air chamber being formed of material that endures repeated high-energy impact and that is essentially impermeable to air;

a plurality of protrusions arranged in an array, each of the plurality of protrusions protruding from the upper surface of the air chamber, wherein there is disposed a top sheet that overlays the protrusions;

wherein each of the protrusions is permeable to air at least in a first area and essentially impermeable to air in at least a second area, and wherein each the of the protrusions are detachably coupled to the at least one air chamber by a detachable closing device, and each of the detachable closing devices is permeable to air such that air is permitted to flow from within the air cushion to outside the air cushion at the detachable closing device.

* * * * *